United States Patent [19]

Covell

[11] Patent Number: 4,634,388

[45] Date of Patent: Jan. 6, 1987

[54] RUDDER FOR ELECTRIC TROLLING MOTOR

[76] Inventor: Walter R. Covell, Rte. #1, Milan, Pa. 18831

[21] Appl. No.: 748,124

[22] Filed: Jun. 24, 1985

Related U.S. Application Data

[63] Continuation-in-part of Ser. No. 603,365, Apr. 24, 1984, abandoned.

[51] Int. Cl.[4] ..... B63H 21/17

[52] U.S. Cl. ..... 440/6; 440/51

[58] Field of Search ..... 114/146, 152, 162, 164, 114/165, 168; 440/6, 7, 51; 248/231; 403/207, 347, 386

[56] References Cited

U.S. PATENT DOCUMENTS

| | | | |
|---|---|---|---|
| 367,871 | 8/1887 | Wall | 114/168 |
| 638,542 | 12/1899 | Atwood | 440/6 |
| 1,138,078 | 5/1915 | Burroughs | 440/51 |
| 1,302,956 | 5/1919 | Owen | 440/51 |
| 1,512,391 | 10/1924 | Abraham | 440/6 |
| 1,966,029 | 7/1934 | Fahrney | 114/162 X |
| 3,285,219 | 11/1966 | Linsley | 440/51 |
| 3,315,631 | 4/1967 | Bass | 440/6 |
| 3,687,101 | 8/1972 | Linsley | 440/51 |
| 3,828,718 | 8/1974 | Jolin | 440/51 |
| 3,991,700 | 11/1976 | Cleary | 440/51 |
| 4,224,893 | 9/1980 | Vollmar | 440/6 |
| 4,265,422 | 5/1981 | Van Leeuwen | 248/231 |

FOREIGN PATENT DOCUMENTS

| | | | |
|---|---|---|---|
| 3555 | of 1894 | United Kingdom | 114/165 |
| 7267 | of 1897 | United Kingdom | 440/6 |

*Primary Examiner*—Sherman D. Basinger

*Attorney, Agent, or Firm*—Woodcock Washburn Kurtz Mackiewicz & Norris

[57] ABSTRACT

A rudder is disclosed for an electric trolling motor in which the rudder is mounted on the shaft thereof above the propeller and in proximity thereto; the rudder comprises a flat portion and at least one minor portion outwardly curved for positioning around a section of the shaft of the electric trolling motor.

11 Claims, 12 Drawing Figures

RUDDER FOR ELECTRIC TROLLING MOTOR

This is a continuation-in-part of Ser. No. 603,365, filed Apr. 24, 1984, now abandoned.

FIELD OF THE INVENTION

This invention relates to rudders and more particularly to rudders for use with electric trolling motors.

BACKGROUND OF THE INVENTION

Fishing may be done using a variety of techniques and equipment. Some types of recreational fishing are done from boats. Such boats may be powered by gasoline engines or electric motors depending on the type of fishing that is being done. One particular type or style of fishing is trolling with the use of an electric outboard motor. Electric trolling motors (ETM) are preferred for certain trolling operations because of a lower power ratio (compared to gasoline), less disturbance to the shallow waters being fished, and their small size.

A rudder is a steering device usually rectangular in shape and frequently comprises a metal blade mounted behind a propeller and quite close to it. A rudder is used to attain and maintain a desired heading. The force necessary to accomplish this is developed by dynamic pressure against the flat surface of the rudder. Various types of rudders have been suggested for use in trolling to aid in steering and to help maintain direction in the water but most of these have been confined to use with gasoline engines.

For example, U.S. Pat. No. 3,991,700 to Cleary teaches a rudder attachment for a gasoline trolling outboard motor where the motor has a gear case, a propeller and a horizontal cavitation plate. The rudder is mounted in an upright position behind the propeller by attachment to the cavitation plate.

U.S. Pat. No. 3,828,718 to Jolin discloses an auxiliary rudder attachable to a gasoline outboard motor to give the person running the boat full control of his steering at all times, including during trolling operations. The rudder is a flat plate 8 inches by 8 inches square with mounting structures including shims, a bracket, and a tension coil spring. Although not expressly stated, the elongated mounting bracket is intended to be placed around an elongated portion of the streamlined motor housing and the rudder supported by a cavitation plate or other horizontal member of the housing member.

U.S. Pat. No. 3,285,219 to Linsley shows a rudder and stabilizer attachment for gasoline outboard motors which is mounted rearwardly of the propeller.

U.S. Pat. No. 3,687,101 to Linsley teaches a marine rudder for use on a gasoline outboard or inboard engine. The rudder is disposed mostly above the cavitation plate and makes straightening of the rudder easier at high speeds.

While a variety of rudders have been suggested for various uses, these rudders are not designed for use with electric trolling motors. A rudder for an electric trolling motor must have a sufficient surface area to create water resistance but sufficiently streamlined to avoid drag hindering the limited power of the electric motor. The mounting of a rudder on an electric trolling motor cannot be done in the same way as for a modern gasoline engine. Virtually all electric trolling motors are provided with a smooth, circular motor tube or shaft connecting the submerged motor and propeller assembly with an operator control unit. In contrast the gasoline outboard motors are generally provided with an elongated, streamlined housing and a cavitation plate structure or other horizontal member which can be used to support and secure a rudder. Thus it is an object of the present invention to provide a rudder for use with an electric trolling motor and mountable to the shaft thereof. It is also an object of the present invention to provide a rudder for an electric trolling motor which aids in keeping a boat on course in rough water, strong winds and/or strong currents. A further object of the invention is to provide a rudder for an electric trolling motor which allows trolling at low speeds in shallow water. It is yet another object of the invention to provide a rudder for an electric trolling motor which reduces problems of oversteering. It is a further object of this invention to provide a safe and light rudder with reduced drag for an electric trolling motor. It is yet another object of the invention to provide a streamlined rudder and mounting for an electric trolling motor which reduces the occurrence of cavitation. Yet another object of the invention is to provide an electric trolling motor rudder which is mounted so as to counterbalance and reduce the motor side thrust component. It is yet another object to provide an electric trolling motor rudder which is symmetric about a horizontal plane to allow the rudder to be used with either clockwise turning or counter-clockwise turning propellers. It is yet another object of the invention to provide an improved, non-slip mounting for securing a rudder to the circular shaft of an electric trolling motor. These and other objects of the invention will be apparent from the following description of the invention.

SUMMARY OF THE INVENTION

The rudder of this invention is an assembly and comprises a flat major portion and at least one curved minor portion located near an edge of the major portion which is curved for at least partial wrap around the circumference of an electric trolling motor shaft and separate securing means for removably positioning and holding the rudder to the shaft above the propeller. Two possible securing means are disclosed: a complementary semi-circular bracket half and an adjustable clamp which surrounds both the shaft and the minor curved portion of the rudder and compresses the minor curved portion against the shaft.

For greater stability and secure mounting it is preferred to provide extending from one or a pair of side edges of the major flat portion of the rudder, two minor curved portions or tabs curved for at least partial and preferably semi-circular wrap around the electric trolling motor shaft. The minor portions may be curved in the same direction or in opposite directions. Rudders of the former type designed for use on straight shafts can be and suggestably are provided with a central horizontal axis of symmetry so that the direction of wrap of the tabs about the shaft may be selected.

The claimed invention also includes such a rudder in combination with a conventional electric trolling motor having a tubular shaft with circular cross section supporting an electric motor and propeller at one end thereof for operation below water and a control means above water at an opposing end of the shaft. Rudders of the present invention are designed to be mounted to and supported solely on the shaft portion of the motor.

DETAILED DESCRIPTION OF THE DRAWINGS

Figure 1:
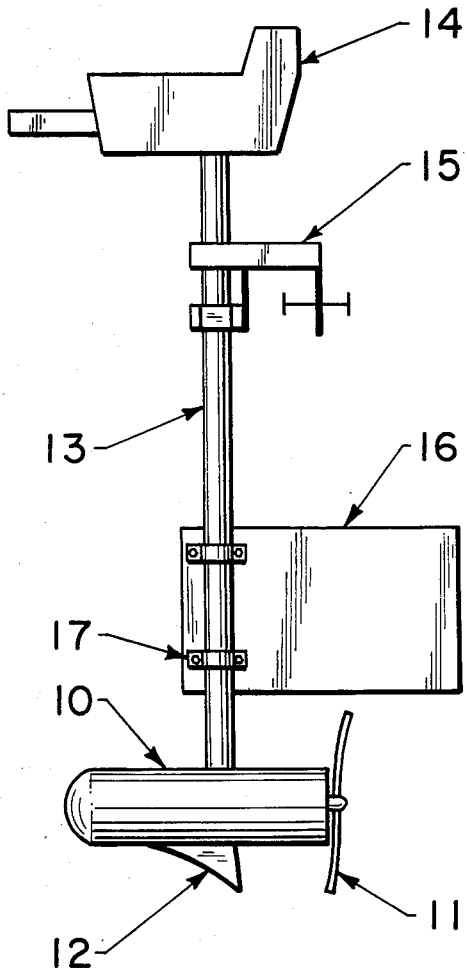
FIG. 1 is an overall view of an electric trolling motor with the rudder invention in place.

FIG. 1 is a generalized view of a straight shaft electric trolling motor (ETM) having a rudder of this invention installed thereon and including a motor 10 with a propeller 11 and propeller guard 12. A hollow motor tube or shaft 13 extends upward from motor 10 and terminates in control means 14. The shafts of virtually all ETM's sold in the United States have a circular cross-section most with a one inch outer diameter. Means for attachment 15, whereby the motor apparatus is attached to the boat, extends from an upper portion of shaft 13 and may also include a tilt position knob for altering the position of the motor and propeller assembly. The rudder 16 of the invention is mounted on shaft 13 above and in proximity to propeller 11, but beyond the radius of the blade of the propeller 11.

Figure 2:
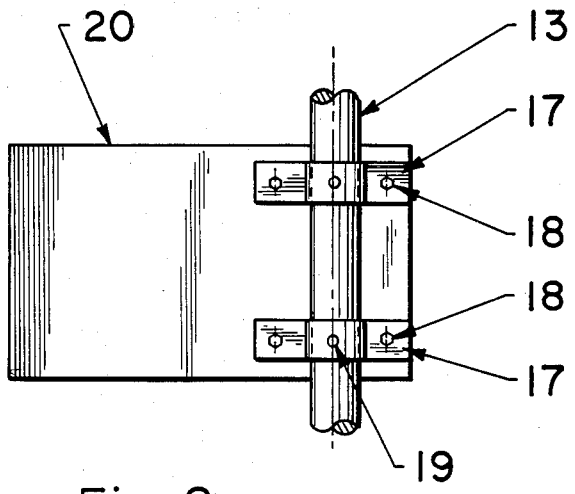
FIG. 2 is a side view of one embodiment of the invention adapted for use with a straight motor shaft.
Figure 3:
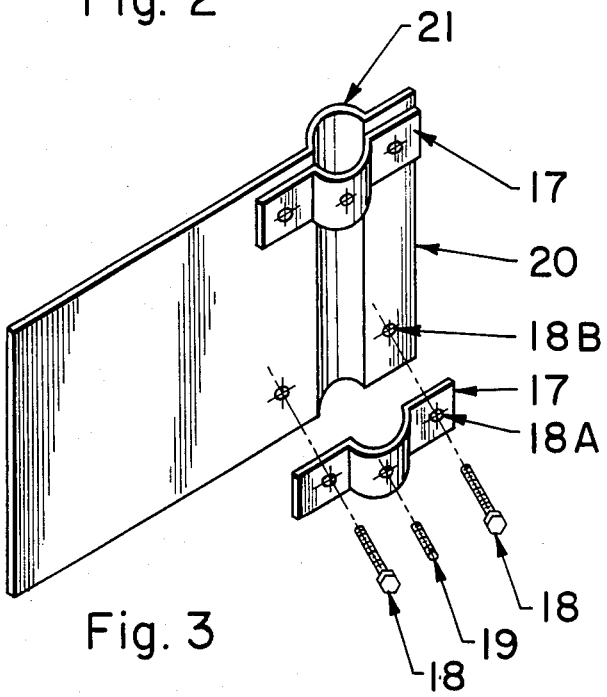
FIG. 3 is an isometric view of the embodiment of FIG. 2 with one of the attachment brackets separated.
Figure 4:
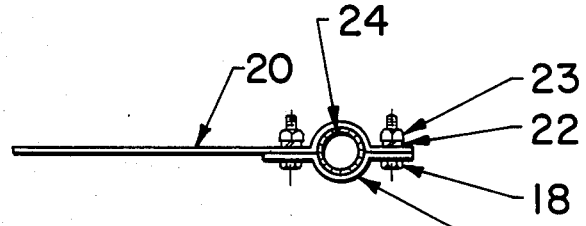
FIG. 4 is a top plan view of the embodiment shown in FIG. 2.

FIGS. 2–4 show one embodiment rudder of this invention in detail comprising a flat major blade portion 20, with an outwardly minor curved portion 21 on one side. The curved portion 21 is better adapted to conform to the circular shaft 13 of an electric trolling motor than would be a flat, planar surface. The rudder is symmetric about a central horizontal axis. The rudder assembly further includes two separate mounting brackets 17 which are also outwardly curved (in a direction opposite to curved portion 21) at approximately their center portions for better adaptation to shaft 13. Each bracket 17 has at least two holes 18A which mate with similar holes 18B through of the rudder and through which bolts 18 are inserted. A set screw 19, provided with each bracket 17, may be used to adjustably secure and position the rudder to the shaft 13. For each bolt 18 it is preferred that a lock washer 22 be placed next to the securing nut 23. Each nut 23 is then tightened into position. A shim 24 may be placed between the shaft 13 and the curved portions of the rudder assembly to fit the assembly to varying diameters of a motor tube or shaft.

Figure 5:
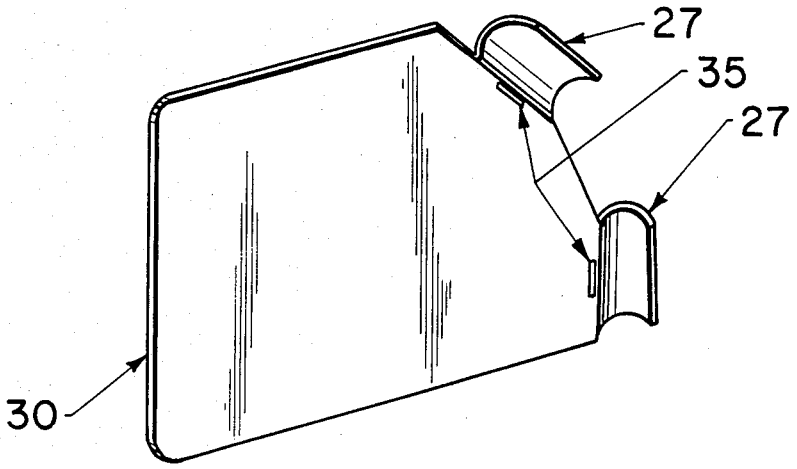
FIG. 5 is a second embodiment of the rudder of this invention adapted for use with a goose-neck shaft.
Figure 5A:
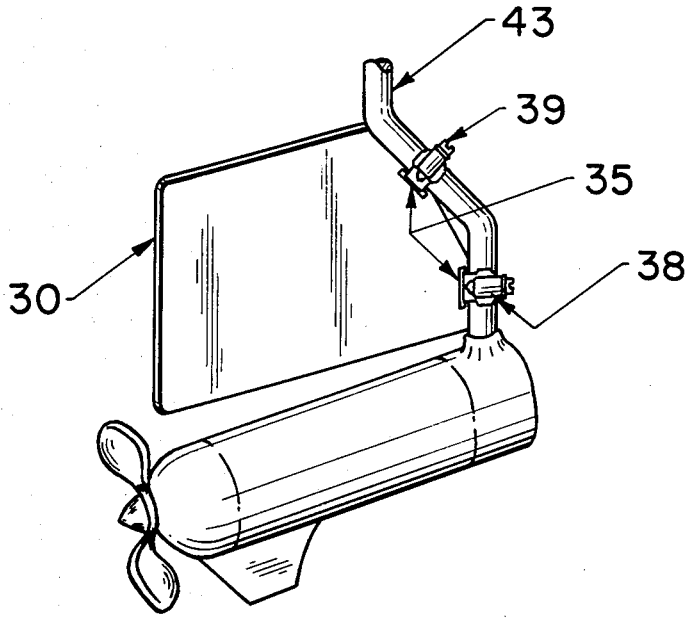
FIG. 5A is an overall view of the rudder of FIG. 5 installed on an electric trolling motor.

FIGS. 5 and 5A show a second embodiment rudder of this invention which will fit electric outboard motors having a bent ETM shaft connecting the control means with the motor and propeller assembly. The rudder comprises a flat major portion 30 shaped as a six-sided polygon. Outwardly curved minor portions or tabs 27 extend from each of two side edges of the major portion for warp around the shaft 43 as explained for FIGS. 2–4. The minor portions are preferably sized and curved for approximately semi-circular wraparound a one-inch diameter shaft 43 of an ETM. A slit 35 is provided along the edge of the major planar portion 30 adjoining each tab 27. Secured around the adjoining tab 27 and shaft 43 is a conventional adjustable band clamp 38, such as a hose clamp which is threaded through a slit 35 and tightened by means of screws 39 to hold the rudder around the shaft 43. This type of mounting does not require set screws, is extremely easy to manufacture in ductile materials such as aluminum and provides and extremely strong and stable mounting, again preferable with a ductile or bendable material such as aluminum as the tabs can be bent with the clamps to conform to and contact a greater surface area of the shaft.

Figure 6:
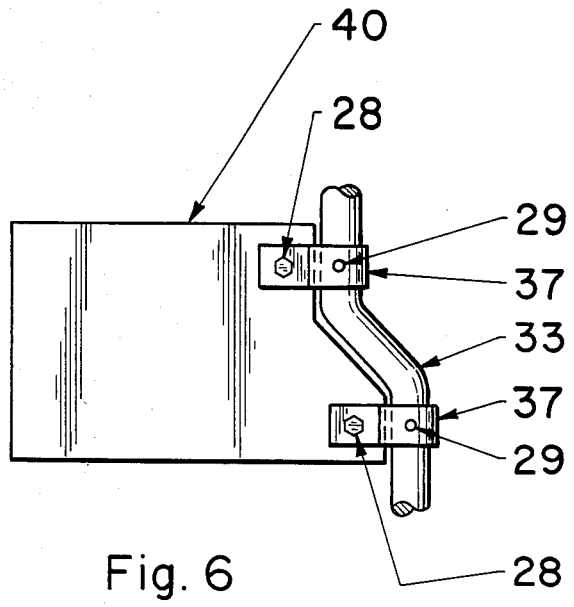
FIG. 6 is a third embodiment of the rudder of this invention adapted for use with a goose-neck shaft.
Figure 7:
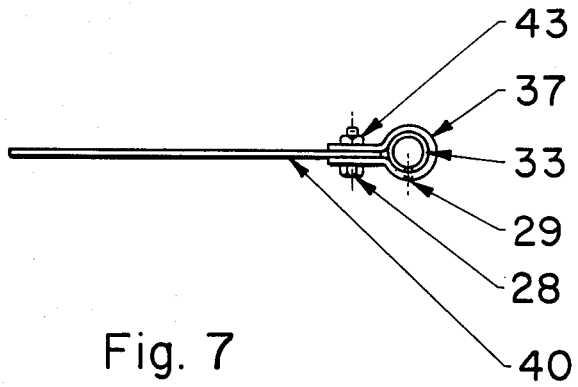
FIG. 7 is a top plan view of the embodiment in FIG. 6.

FIGS. 6–7 show a third embodiment of the rudder of this invention as adapted for use with a goose-neck shaft. The rudder comprises a flat major portion 40 angled along one side to conform to the goose-neck shape of shaft 33. Circular brackets 37 passed around the leading edge of shaft 33 and attached to the flat major portion 40 along a trailing edge of the shaft with a bolt and lock washer assembly 28 providing a more streamlined mounting that of FIGS. 2–4. The bolt is tightened against nut. Set screws 29 are provided for better adjustment.

DESCRIPTION OF PREFERRED EMBODIMENTS

Figure 8:
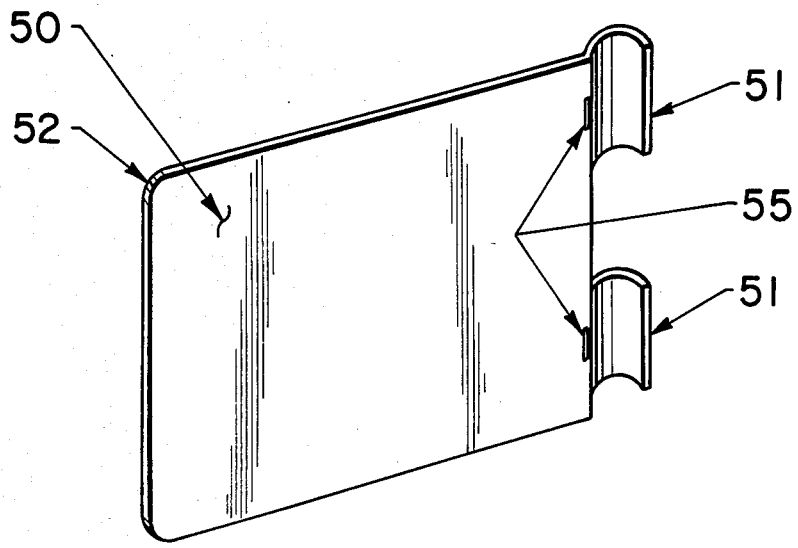
FIG. 8 is an isometric view of a preferred embodiment of the invention.
Figure 8A:
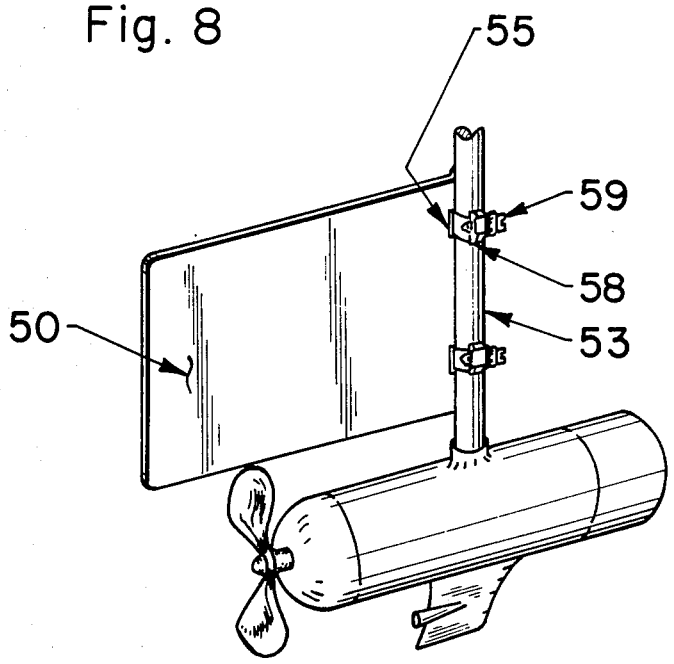
FIG. 8A is an overall view of the rudder of FIG. 8 installed on an electric trolling motor.

FIGS. 8 and 8A show a fourth embodiment of the rudder assembly of this invention comprising a flat major portion 50 with rounded ends 52 and at least two minor curved or tab sections 51 extending from a side edge of the major portion 50 again curved for at least partial and, preferably, semi-circular wrap around a shaft 53. FIG. 8 shows tab sections 51 as curved in the same direction to fit along the same side of shaft 53. The tabs 51 and major portion 50 are symmetric with respect to a central horizontal axis through the major portion 50 allowing the curve of the tabs to be reversed with respect the shaft, if desired, when mounting. The rudder assembly is again positioned and held in place on shaft 53 by means of adjustable clamps 58 threaded through slits 55 in the major portion adjoining each tab 51 and tightened with screws 59. The embodiment shown in FIGS. 8 and 8A may be adapted to fit a wide variety of diameters of shafts for electric trolling motors.

Figure 9:
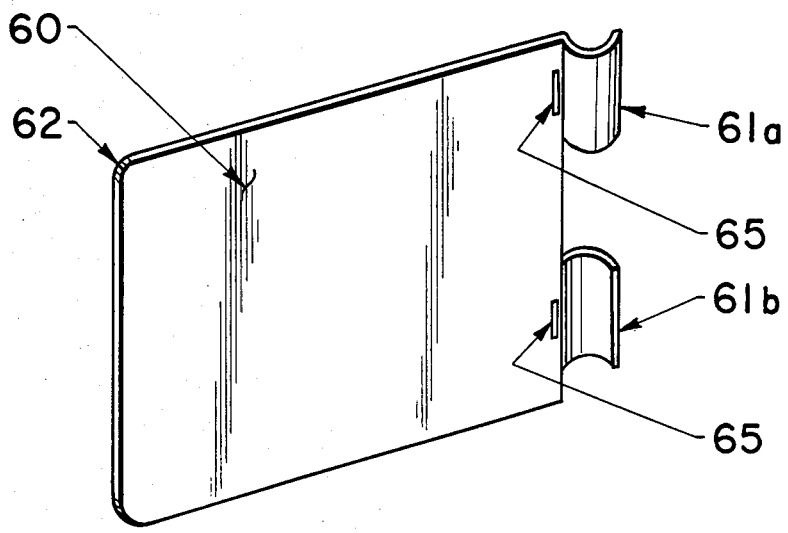
FIG. 9 is another preferred embodiment of the rudder of this invention.
Figure 9A:
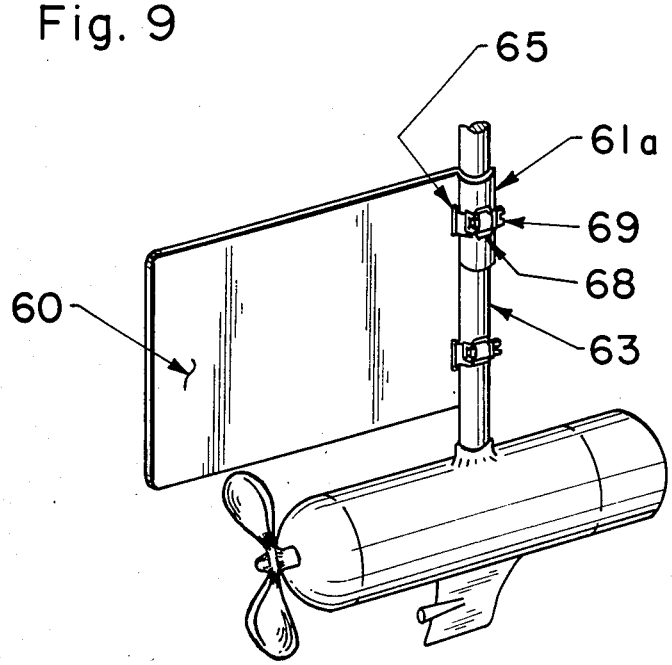
FIG. 9A is an overall view of the rudder of FIG. 9 installed on an electric trolling motor.

FIGS. 9 and 9A show an alternative structure of the fourth embodiment comprising a flat major portion 60 with rounded ends 62 and two minor curved or tab sections **61*a* and 61*b* extending from a side edge of the major portion 60 and which are curved in opposite directions from each other. Again, securing means in the form of hose clamps 68 are threaded through slits 65 in the major portion adjoining each tab and tightened by means of screws 69. The embodiment shown in FIGS. 9 and 9A is able to more effectively use water pressure to maintain stability because the minor or tab sections 61*a* and 61*b* are wrapped around shaft 63 in opposite directions. Apart from the direction of curvature, the tabs 61*a* and 61*b* are identical and uniformly spaced from a horizontal centerline 60*a*** of the major portion allowing the rudder to be mounted with either tab on top.

In the preferred embodiments shown in FIGS. 8, 8A, 9 and 9A, the major planar portion and tabs are fabricated monolithically from a flat piece of aluminum approximately 1/16 inch thick. The minor portions or tabs are formed on one end at the major portion and are curved to fit approximately halfway around the shaft. Preferred aluminum compositions are 1100H14 and 3003H14. These aluminums are sufficiently pliant to deform under the compression of an adjustable clamp to conform to and contact a greater surface area of the shaft, thereby increasing frictional locking force. Stainless steel hose clamps approximately ½ inch wide are threaded through slits and the screws tightened into position. The preferred rudder is constructed so that the flat portion is approximately 6 inches wide and 7½ inches long. The rudder is preferably mounted about ½ inch above the radius of the propeller blade. Most ETM's are designed for a clockwise rotation (i.e. right-handed spiral), when viewed from the stern, for forward propulsion. For such ETM's, it is preferred that the curved tabs 27 and 51 of the embodiment of FIGS. 5, 5A, 8 and 8A wrap in a clockwise direction around the shaft (when viewed from above) extending from the flat major portion of the rudder. Where tabs are provided with opposite curvatures, like tabs 61*a* and 61*b* of FIGS. 9 and 9A, it is preferred that the lower tab have the clockwise wrap around the shaft of an ETM with a right-handed spiral propeller.

It will be appreciated by those skilled in the art that a variety of factors may affect the choice of size for the rudders of this invention, e.g. boat size, motor size, and power, propeller size, and speed of current. A suggested size range for the rudder of this invention would be in the area between about 3 inches×3 inches and 18 inches×18 inches for the normal range of recreational boats using electric motors. The rudder of the invention may be constructed in a variety of shapes including squares, rectangles, polygons and ovals. The rudder may be constructed from a variety of materials including aluminum (preferred), stainless steel, various types of plastics or plastic coated materials, fiberglass or fiberglass coated materials, brass and composite materials, e.g. those containing graphite.

While various embodiments of the invention have been described, changes or modifications to the embodiments described may occur to those skilled in the art; these may be made without departing from the spirit or scope of the invention.

I claim:

1. A rudder assembly for an electric outboard trolling motor comprising:

a flat major portion having at least one side edge;

at least one minor portion integrally joined with said flat major portion along said one side edge of the flat major portion and curved for at least partial wrap around a section of a circular shaft of said electric outboard trolling motor;

a second minor portion rigidly and integrally joined to said major portion along a side edge of said major portion and curved for positioning in a partial wrap around a different section of the same shaft;

a pair of apertures each positioned proximate to a different one of said two minor portions;

separate securing means for positioning and holding said curved one minor portion of said rudder against said shaft, above a propeller of said electric trolling motor in proximity to said propeller, at least part of said securing means being detachable from the remainder of said rudder assembly sufficiently to position said shaft between said one minor portion and said securing means, said rudder assembly being adapted to be supported solely by said circular shaft;

second securing means cooperating with said second minor portion for positioning and holding said second curved portion of said rudder against said shaft, at least part of said second securing means being detachable from said rudder assembly sufficiently to position said shaft between said second minor portion and said second securing means, said rudder assembly being positionable and supportable on said electric trolling motor circular shaft solely by said two minor curved portions and said two securing means for positioning and holding; and said two securing means for positioning and holding each comprising a flexible band clamp, the band of each clamp being passed through a different one of said apertures and around said circular shaft and the minor portion of the rudder assembly proximate said aperture.

2. The rudder assembly of claim 1 wherein said major portion and two minor portions are symmetric about a central axis through the major portion.

3. The rudder assembly of claim 1 wherein centers of curvature of each of the two minor portions are not parallel to one another.

4. The rudder assembly of claim 1 wherein said flat major portion is rectangularly shaped and has a length greater than its height.

5. The rudder assembly of claim 1 wherein the minor portion is made of a material deformable under compression by said clamp.

6. The rudder assembly of claim 1 wherein the flat portion is a polygon having at least four sides.

7. The rudder assembly of claim 1 wherein the flat major portion is six sided.

8. The rudder assembly of claim 1 wherein said minor portions and major planar portion are formed of aluminum sufficiently thin to be bendable when compressed about a shaft by said adjustable clamp.

9. The combination comprising:

an electric trolling motor having a tubular shaft supporting an electric motor and propeller at one end thereof for operation below water and control means for controlling said motor at an opposing end thereof;

a planar rudder assembly extending substantially transversly and elongatedly from said shaft above said propeller and said electric motor in proximity to said propeller and below the water when the trolling motor is in operation, supported solely by said circular shaft, removably attached to said shaft and including:

a flat major portion;

at least one minor portion rigidly and integrally joined with said flat major portion in the form of a curved tab extending from a side edge of said flat portion, and partially wrapped about a first side of a section of said shaft; p1 at least one additional curved tab extending from a side edge of said flat portion and also partially wrapped about a different portion of said shaft;

said flat major portion further including apertures adjoining each of said curved tabs; and securing means cooperating with said curved tabs for fixidly positioning and supporting said rudder on said shaft, said securing means including a pair of flexible, adjustable band clamps each passing through one of the apertures and about the adjoining tab and shaft for compressing said tab around and against said shaft.

10. The combination of claim 9 wherein said flat portion and connected tabs are formed from a single piece of material.

11. A rudder assembly for an electric outboard trolling motor comprising:

a flat major portion;

at least one minor portion extending from a side edge of the major portion curved for at least partial wrap around a section of a circular shaft of said electric outboard trolling motor;

a second minor portion extending from an edge of the flat major portion and curved for at least partial wrap around another portion of the same circular shaft;

a pair of apertures in the flat major portion each adjoining each of the minor portions; and a pair of flexible adjustable band clamps each securable through one of said apertures and around the adjoining minor curve portion for positioning and holding said curved portion of said rudder against said shaft, above a propeller of said electric trolling motor in proximity to said propeller, at least part of said pair of flexible adjustable band clamps being detachable from the remainder of said rudder assembly sufficiently to position said shaft between said minor portions and said band clamps, the rudder assembly being adapted to be supported solely by said circular shaft.

* * * * *